US012342943B2

(12) United States Patent
Djankovich

(10) Patent No.: US 12,342,943 B2
(45) Date of Patent: Jul. 1, 2025

(54) PORTABLE REBOUNDING DEVICE WITH ADJUSTABLE AND COLLAPSIBLE FEATURES

(71) Applicant: Rocking Inc., Winnetka, IL (US)

(72) Inventor: Mladen Djankovich, Coral Gables, FL (US)

(73) Assignee: Rocking Inc., Winnetka, IL (US)

( * ) Notice: Subject to any disclaimer, the term of this patent is extended or adjusted under 35 U.S.C. 154(b) by 0 days.

(21) Appl. No.: 17/975,336

(22) Filed: Oct. 27, 2022

(65) Prior Publication Data

US 2023/0129979 A1 Apr. 27, 2023

Related U.S. Application Data

(60) Provisional application No. 63/272,484, filed on Oct. 27, 2021.

(51) Int. Cl.

| | |
|---|---|
| ***A47C 3/02*** | (2006.01) |
| ***A47C 4/02*** | (2006.01) |
| ***A47C 4/03*** | (2006.01) |
| ***A47C 7/38*** | (2006.01) |
| ***A47C 7/40*** | (2006.01) |

(Continued)

(52) U.S. Cl.

CPC ..... *A47C 7/441* (2013.01); *A47C 3/02* (2013.01); *A47C 4/03* (2013.01); *A47C 7/38* (2013.01); *A47C 7/443* (2013.01); *A47C 7/444* (2018.08); *A47D 13/10* (2013.01); *A47D 13/107* (2013.01)

(58) Field of Classification Search

CPC .. A47C 3/02; A47C 4/02; A47C 7/443; A47C 7/444; A47C 7/407; A47C 3/16; A47D 13/10; A47D 13/107

USPC ..... 297/16.1, 252, 352, 285, 289, 292, 293, 297/440.15, 440.16

See application file for complete search history.

(56) References Cited

U.S. PATENT DOCUMENTS 5,207,478 A * 5/1993 Freese ..... A47D 13/101 297/16.1 X
5,269,591 A * 12/1993 Miga, Jr. ..... A47D 13/107 297/16.1 X (Continued)

FOREIGN PATENT DOCUMENTS

| | | | | |
|---|---|---|---|---|
| CH | 673567 A * | 3/1990 | ..... | A47C 7/443 |
| EP | 2345345 A1 * | 7/2011 | ..... | A47C 7/443 |
| WO | WO-0117398 A1 * | 3/2001 | ..... | A47C 1/0242 |

*Primary Examiner* — Rodney B White
(74) *Attorney, Agent, or Firm* — K&L Gates LLP

(57) ABSTRACT

A rebounding device includes a front member, a rear member, and a junction member releasably coupling the front member and the rear member is disclosed. The junction member enables the front member and the rear member move between a collapsed position and an expanded position, and the front member is movable relative to the rear member during a rocking motion when the junction member is in the expanded position. In one embodiment, the junction member comprises a ratchet gear, a spring-loaded pawl configured to engage the ratchet gear and prevent rotation thereof, and a torsion spring. Application of pressure by a user against the front member causes the front member to move toward the rear member, thereby loading the torsion spring. Removal of the pressure against the front member causes the torsion spring to unload, thereby biasing the front member away from the rear member.

10 Claims, 9 Drawing Sheets

(51) Int. Cl.
*A47C 7/44* (2006.01)
*A47D 13/10* (2006.01)

(56) References Cited

U.S. PATENT DOCUMENTS 5,308,143 A * 5/1994 Cheng ..... A47D 1/002 297/292 X
5,451,095 A * 9/1995 Riback ..... A47D 13/107 297/440.11
5,460,430 A * 10/1995 Miga, Jr. ..... A47D 13/101 297/51
5,921,627 A * 7/1999 Risetter ..... A01M 31/025 297/293 X
6,594,840 B2 * 7/2003 Tomas ..... A47D 13/107 5/655
6,739,649 B2 * 5/2004 Kelly ..... A47D 9/057 297/440.1
6,877,802 B2 * 4/2005 Christensen ..... A47D 13/101 297/16.1 X
6,902,230 B2 * 6/2005 Chen ..... A47D 13/107 297/16.1
7,779,490 B2 * 8/2010 Bergkvist ..... A47D 1/002 297/DIG. 11
8,376,375 B2 * 2/2013 Mival ..... B62B 7/08 297/16.1 X
8,696,064 B2 * 4/2014 Pan ..... A47C 7/443 297/285
8,746,794 B2 * 6/2014 Oren ..... A47D 9/053 297/274 X
9,095,228 B2 * 8/2015 Gooris ..... A47D 9/016
9,713,392 B2 * 7/2017 Vinje Brustad ..... A47D 1/002
9,848,715 B2 * 12/2017 Soriano ..... A47D 13/102
9,925,893 B1 * 3/2018 Burmeister ..... B60N 2/2881
2006/0202533 A1 * 9/2006 Goodman ..... A47C 7/402 297/352
2011/0127810 A1 * 6/2011 Lee ..... A47D 13/101 297/16.1
2017/0340120 A1 * 11/2017 Chen ..... A47C 7/444
2021/0321776 A1 * 10/2021 Plant ..... A47C 7/444
2023/0190010 A1 * 6/2023 Skilnick ..... A47D 1/004 297/274

* cited by examiner

PORTABLE REBOUNDING DEVICE WITH ADJUSTABLE AND COLLAPSIBLE FEATURES

CROSS-REFERENCE TO RELATED APPLICATIONS

This application incorporates by reference and claims the benefit of priority to U.S. Provisional Application 63/272,484 filed Oct. 27, 2021, the disclosure of which are hereby incorporated by reference.

BACKGROUND OF THE INVENTION

The present subject matter relates generally to a portable rebounding apparatus. More specifically, the present invention relates to a rebounding device to be used against a stationary surface for generating a rebounding motion that includes various adjustable and/or collapsible features.

Rocking is a familiar part of everyday human life. Numerous proven benefits of rocking have been established for centuries, while modern medicine has discovered new motivations and added reasons for rocking. One of the most well-known uses for rocking is to calm a baby. The gentle bouncing motion mimics the movement the baby felt inside the mother's womb and can soothe infants, aid in lulling children to sleep or while nursing, and reduce crying in colic episodes. Rhythmic motions also help build a better attachment bond between the parent and child, and aids in the growth of the newborn by stimulating both motor and sensory development.

Rocking for personal benefit is a safe activity and option for those that live an otherwise sedentary lifestyle or for people with limited physical motion, including many aging adults, individuals suffering with injuries or chronic ailments, or those seated for long periods of time. The act of rocking has proven benefits such as the easing of arthritis and back pain, improved muscle tone, improved balance, and increased circulation. Studies have shown that patients with Alzheimer's disease that rock regularly demonstrate a significant improvement in depression, anxiety, balance, and a decrease in pain medication usage.

Studies have revealed that rocking causes an increase in psychological well-being for those suffering from dementia, anxiety, and depression due to released endorphins that elevate the mood. Additional studies suggest benefits of rocking can provide comfort and add to the positive treatment of anxiety, attention deficit disorder, attention deficit hyperactivity disorder (ADHD), and autism. For example, studies of patients with ADHD show that rocking movement with particular intensities and frequencies is correlated with increased accuracy on cognitively demanding tasks requiring sufficient attention. Studies have also shown that vestibular rehabilitation therapy such as rocking can help patients with vestibular dysfunction, such as vertigo and episodes of dizziness. Rocking may also be a low-energy movement to increase blood flow for those experiencing physical restrictions, such as elderly and those with limited mobility or physical disabilities. Health experts recommend some form of motion to increase circulation and muscle movement when sitting or laying for extended periods. Rocking has also been shown to help people fall asleep faster and improve memory consolidation with more time spent in non-REM sleep.

Rocking can also improve pain management by calming the parasympathetic nervous system. It also improves cognitive processing by soothing the brain and facilitating concentration with the ability to think logically.

However, prolonged rocking in a seated position cannot be performed comfortably without an external device such as a rocking chair to assist in repeating the motion for even a short period of time, let alone hours on end. A continuous rocking motion for long durations without assistance also creates significant strain on muscles and joints. Existing solutions are extremely limited in their embodiments, versatility, and flexibility of use. The operating conditions and other utility requirements often prohibit users from being able to use existing apparatuses when and where rocking assistance is needed most.

Further, conventional rocking solutions require a large amount of floor space and are therefore not suitable for use in small rooms and can be difficult to store when not in use. While some hospitals and nurseries equip parents, staff, and caregivers with rockers or gliders, providing a rocker or glider in each room is expensive, which becomes problematic for facilities operating with a limited budget. Smaller options for rocking infants include bassinets, bouncers, or cradles, but in these options the infant is separated from the caregiver, limiting the ability to simultaneously hold, nurse, or easily feed the infant while rocking.

Still further, conventional rocking solutions cannot be combined with other existing furniture such as a sofa or bed, thus preventing users from utilizing such furniture when needing to hold and nurse or calm an infant with rocking. Many mothers prefer to nurse while sitting in an upright position in bed, especially at night, but must choose between the comfort of a bed and the functionality of rocking furniture because nothing exists to allow both simultaneously.

Conventional rocking solutions also present the problem in lacking adaptability to the user of the furniture. For example, a rocking chair may be perfectly comfortable for adult use but may be too strenuous for an elderly person, a person recovering from surgery, a person with limited mobility, a person with physical challenges, etc. The force needed to generate full backwards and forward cycle on a rocker or glider may be easily provided by the leaning back of a larger, heavier body, whereas smaller framed persons, those with pre-existing conditions, and/or aging individuals may need to repeatedly push off the ground using their legs in order to generate motion. With conventional rocking chairs and gliders it can be difficult to achieve partial rock cycles or more subtle motion when the user or child may prefer gentle rebounding rhythm. The size, shape, and condition of the user's body and the personal preference of the user impacts the amount or size of the force needed when utilizing rocking furniture, and a conventional piece of rocking furniture fails to accommodate the variety of needs of multiple users.

Additionally, the use of conventional rocking furniture is limiting in that it cannot easily be moved from room to room or accompany the user during travel. For example, rocking chairs and gliders are not movable for travel. Portability of a rocking solution is desirable for parents who want to take the rocking solution to the park, to the nanny's house, or on vacation, medical staff who want to move the rocking solution between hospital rooms, and even video game players who want to use the rocking solution while at a friends' house for video game night. As such, a need for an ergonomic rocking solution that moves into a collapsed travel position and includes adjustable components exists. An ideal ergonomic rocking device, such as the solution disclosed herein, has adjustable parts that support a healthy sitting posture and features that promote movement while sitting.

Accordingly, there is a need for a portable, compressible rebounding device for generating a rocking motion while in a seated position that is adjustable and/or collapsible to accommodate the needs of different users, as described herein.

BRIEF SUMMARY OF THE INVENTION

To meet the needs described above and others, the present disclosure provides a rebounding device that includes collapsible, modular components to allow for easy assembly and disassembly. The rebounding device further comprises an adjustable force mechanism to accommodate the needs of users having different sizes, shapes, and needs.

The rebounding device described herein includes a front member and a rear member releaseably coupled to one another by one or more junction members. Each junction member includes an force adjustment assembly. During use, the user positions the rear member of the rebounding device against a stationary object such as a chair or a wall. The user rests his back against the front member and applies pressure and/or a backward force to generate a gentle rocking motion. The rebounding device exerts a biasing force when compressed that gently propels the user's upper body forward while maintaining a seated position. The biasing force is determined in part by the setting of the adjustable force mechanism.

In one embodiment, the rebounding device includes a front member, a rear member, and a junction member releasably coupling the front member and the rear member. The junction member includes a ratchet gear, a spring-loaded pawl configured to engage the ratchet gear and prevent rotation thereof, and a torsion spring. Application of pressure by a user against the front member causes the front member to move toward the rear member, thereby loading the torsion spring. Removal of the pressure against the front member causes the torsion spring to unload, thereby biasing the front member away from the rear member.

Adjustment of the force adjustment assembly is provided by rotating a knob in first and second directions, thereby increasing and decreasing the preloaded tension of the torsion spring, respectively. More specifically, as the knob is rotated in a first direction, a spring-loaded pawl resists rotation of a ratchet gear, thereby loading the torsion spring and increasing the tension therein. As the knob is rotated in a second, opposite direction, the tension in the torsion spring is released.

In various instances, the front and rear members include body portions formed of a flexible material extending between the boundaries of their respective frames. The front and rear flexible materials are tightly stretched across the front and rear members, respectively, so that pressure applied to the material causes the front member to move towards the rear member and vice versa. A foam padding or other thick material may be secured to each of the front and rear members and/or flexible material.

An object of the invention is to provide a solution for a collapsoible rebounding device, wherein the modular components are easily moved between a collapsed position for traveling and an expanded position for use, and/or are easily assembled and disassembled.

Another object of the invention is to provide a solution for adjusting the strength of a bouncing motion provided by a rebounding device while maintaining a smooth bouncing motion throughout the range of strength available.

Another object of the invention is to provide a solution to render a single rebounding device usable for a number of people having different shapes, sizes, and rebounding motion needs.

A further advantage of the invention is that it enables a single rebounding device available for use in a wide variety of settings, from childcare to elder care, etc.

An advantage of the invention is that it provides a portable rebounding device that is easily carried from one location to another, takes up little space, and can be easily dismantled and stored away when not in use.

Another advantage of the invention is that it can be utilized with almost any existing furniture or supporting surface; thereby allowing the user to rock continuously while playing games while sitting wherever they have a supporting surface deemed comfortable.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
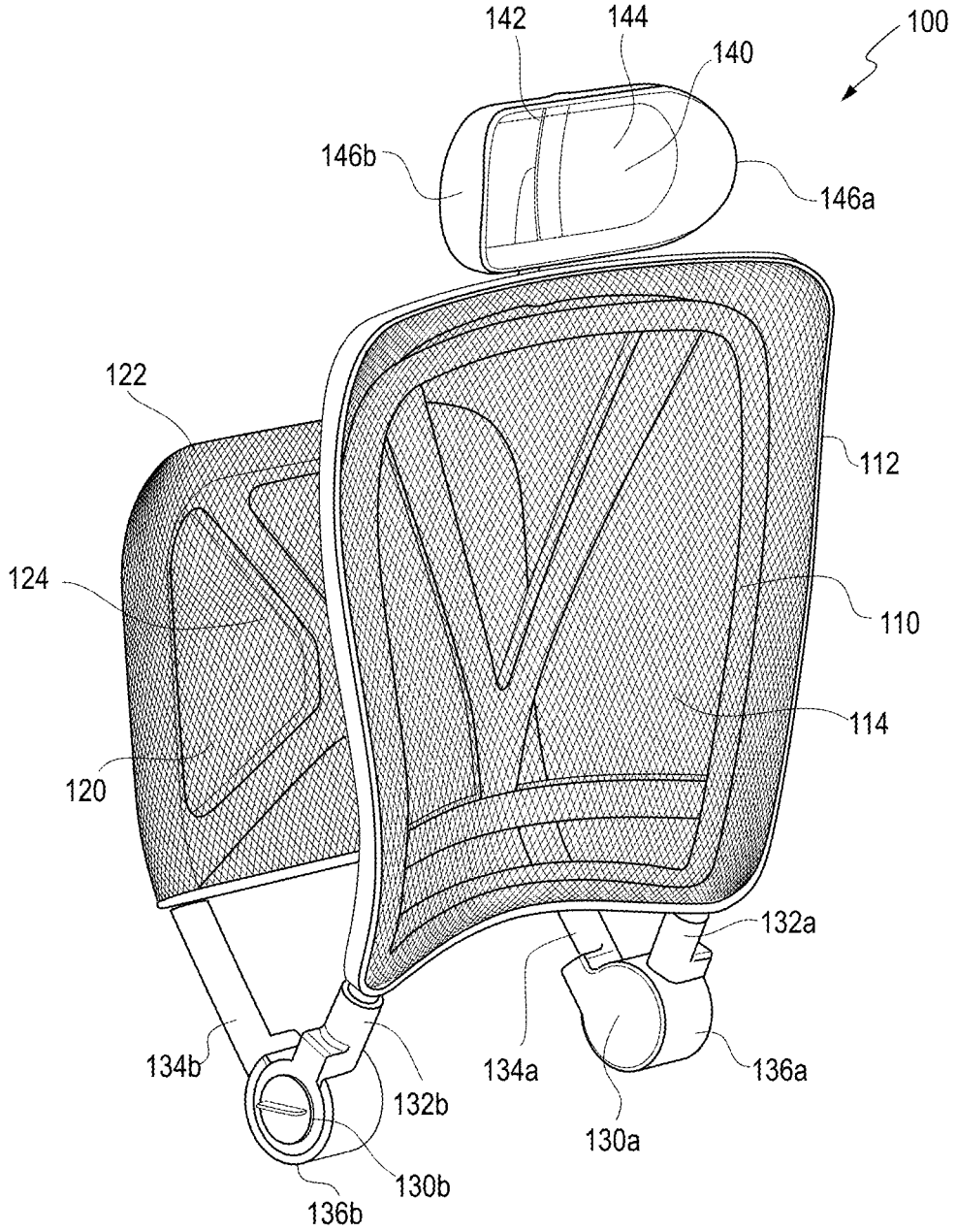
FIG. 1 is a front, perspective view of a rebounding device including a front panel and a back panel joined together by junction mechanism in accordance with at least one aspect of the present disclosure.

FIG. 1 illustrates an example embodiment of a rebounding device 100 that includes various modular components. As shown in FIG. 1, the rebounding device 100 includes a front member 110 and a rear member 120 releasably coupled together by junction members 130*a*, 130*b* as described in greater detail below.

Figure 2:
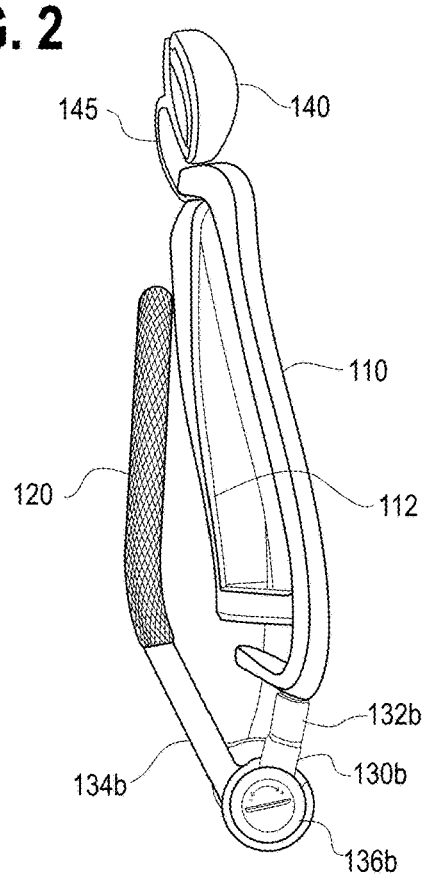
FIG. 2 is a plan view of the rebounding device of FIG. 1.

The front member 110 includes a frame 112 and a body portion 114. The frame 112 can be comprised of a plastic and/or metal material to provide sufficient structure and shape to the front member 110; however, any suitable material can be used to manufacture the frame 112. In the illustrated embodiment, the frame 112 includes an outer frame member 112*a* having a rectangular shape with a curvature to accommodate the shape of the user's back and an inner frame member 112*b* to provide structural support for the outer frame member 112*a* during rocking. The outer frame member 112*a* has a concave curvature along both the width thereof as best seen in FIG. 1 and along the height thereof as best seen in FIG. 1 for receiving the back of the user. Referring to FIG. 2, the inner frame member 112*b* has a lower horizontal bar 112*c* that spans lower portions of opposing side edges of the outer frame member 112*a* and includes a concave curvature with respect to the outer frame member 112*a*. A vertical bar 112*d* of the inner frame member 112*b* spans a midpoint of the lower horizontal bar 112*c* and a midpoint of an upper edge of the outer frame member 112*a*. The horizontal and vertical bars 112*c*, 112*d* provide structural support for the outer frame member 112*a* during rocking use. In other embodiments, the front member 110 may have different or no curvature, and/or the shapes of the frame 112, the outer frame member 112*a*, and the inner frame member 112*b* may be modified as desired or required.

In various instances, the body portion 114 comprises a mesh material stretched across the frame 112 to act as a support for a user's back, although any suitable fabric, plastic, and/or other material is envisioned for use as the body portion 114. Furthermore, the body portion 114 can be coupled to the frame 112 in any suitable manner that results in a resting surface with adequate tension to support the user's back thereon. For example, the body portion 114 can be stretched over the frame 112 and secured using fasteners or the body portion 114 can be integrally formed with the frame 112.

A head rest panel 140 extends vertically above the front member 110. Similar to the front member 110, the head rest panel 140 includes a frame 142 and a body portion 144. The frame 142 can be comprised of a plastic and/or metal material to provide sufficient structure. The body portion 144 extends between and/or around the bounds of the frame 142. As shown in FIG. 1, the body portion 144 is comprised of a fabric, such as mesh, for example. In various instances, the body portion 144 can be comprised of a plastic or any suitable combination of materials. The body portion 144 can be coupled to the frame 142 in any suitable manner that results in a resting surface with adequate tension to support the user's head thereon. The head rest panel 140 is contoured to comfortably receive a rear portion of a head and/or neck of the user therein. Stated another way, first and second sides 146*a*, 146*b* of the head rest panel 140 curve inward to closely surround a user's head and/or neck thereby providing support thereto.

As shown in FIG. 2, a resilient, or flexible, connection member 145 connects the head rest panel 140 to the front member 110. The resilient connection member 145 allows the head rest panel 140 to move and/or be biased relative to the front member 110. For example, a backward force is applied to the head rest panel 140 as a result of a user's head leaning backward. In response to the backward force, the resilient connection member 145 allows for the head rest panel 140 to correspondingly tilt and/or extend backward while still providing support to the user's head and/or neck. When the backward force is no longer applied to the head rest panel 140, the resilient connection member 145 biases the head rest panel 140 back into its upright, normal position.

While the depicted embodiment shows the head rest panel 140 as being coupled to the front member 110 through a resilient connection, any suitable connection mechanism is envisioned. For example, the head rest panel 140 can be coupled to the front member 110 through a telescoping shaft having rigid or flexible properties. In instances where the head rest panel 140 is coupled to the front member 110 through a telescoping shaft, the vertical position of the head rest panel 140 with respect to the front member 110 can be adjusted based on user preference, for example. In various instances, the head rest panel 140 is removably coupled to the front member 110. In such instances, the head rest panel 140 can be removed from the rebounding device 100 for storage purposes, packing purposes, and/or in situations where the user does not desire to have head and/or neck support, for example.

Similar to the front member 110, the rear member 120 includes a frame 122 and a body portion 124. The frame 122 includes an outer frame member 122*a* and an inner frame member 122*b*, with the inner frame member 122*b* including a cross-shape to provide structural support for the outer frame member 122*a*. Other shapes for the frame 122, the outer frame member 122*a*, and the inner frame member 122*b* may be used as desired. The frame 122 can be comprised of a plastic and/or metal material to provide sufficient structure and shape to the rear member 120; however, any suitable material can be used to manufacture the frame 122. In various instances, the body portion 124 comprises a mesh material stretched across the frame 122 to act as a support surface to rest the rear member 120 against a solid surface, such as a wall and/or chair, for example; however, any suitable fabric, plastic, and/or other suitable material is envisioned for use as the body portion 124. Furthermore, the body portion 124 can be coupled to the frame 122 in any suitable manner that results in a resting surface with adequate tension to support the rebounding device 100 against an opposing solid surface. For example, the body portion 124 can be stretched over the frame 122 and secured using fasteners or the body portion 124 can be integrally formed with the frame 122 for example.

A foam pad, a rubber material such natural latex, or other thick, cushioning material may be secured to the front member 110, head rest panel 140, and/or the rear member 120. The material forming the body portion 114 may extend around the entire front member 110 or may be limited to surrounding only a user-facing surface of the front member 110. The material forming the body portion 144 may extend around the entire head rest panel 140 or may be limited to surrounding only a user-facing surface of the head rest panel 140. Similarly, the material forming the body portion 124 may extend around the entire rear member 120 or may be limited to surrounding only a solid surface-facing surface of the rear member 120. Such materials may be a plastic such as a polyvinyl chloride, a carbon fiber composite material, a leather material, or any other suitable material or combinations of materials. In some embodiments, the body portions 114, 124, 144 may also include a plurality of layers, including one or more of the following: a cushioning material, a rubber material, a para-aramid synthetic fiber material such as Kevlar, and a fabric or leather outer layer. The dimensions of the front, rear, and head rest body portions 114, 124, 144 result in sufficiently taut surfaces so as to support the user's weight and a bouncing force.

During use, the rear member 120 is configured to rest against a solid surface. The user positions his back against the front member 110 and applies pressure to create a gentle, rocking motion. The user positions the rebounding device 100 between his back and a solid, supporting surface such as the headboard of a bed, the back of a sofa, an airplane seat, or a wall, for example. The rebounding device 100 exerts a biasing force through the junction members 130*a*, 130*b* when compressed that propels the user's upper body forward while maintaining a seated position. The combination of the biasing force of the rebounding device 100 against the weight of the user generates a momentum that allows continued bouncing while rocking an infant or oneself for gaming, personal relaxation, activity, or comfort, while requiring little effort for hours on end. One or both of the junction members 130*a*, 130*b* of the rebounding device 100 include a force adjustment assembly that enables the user to adjust the amount of rebounding force provided by device 100, as described in greater detail herein.

Figure 3:
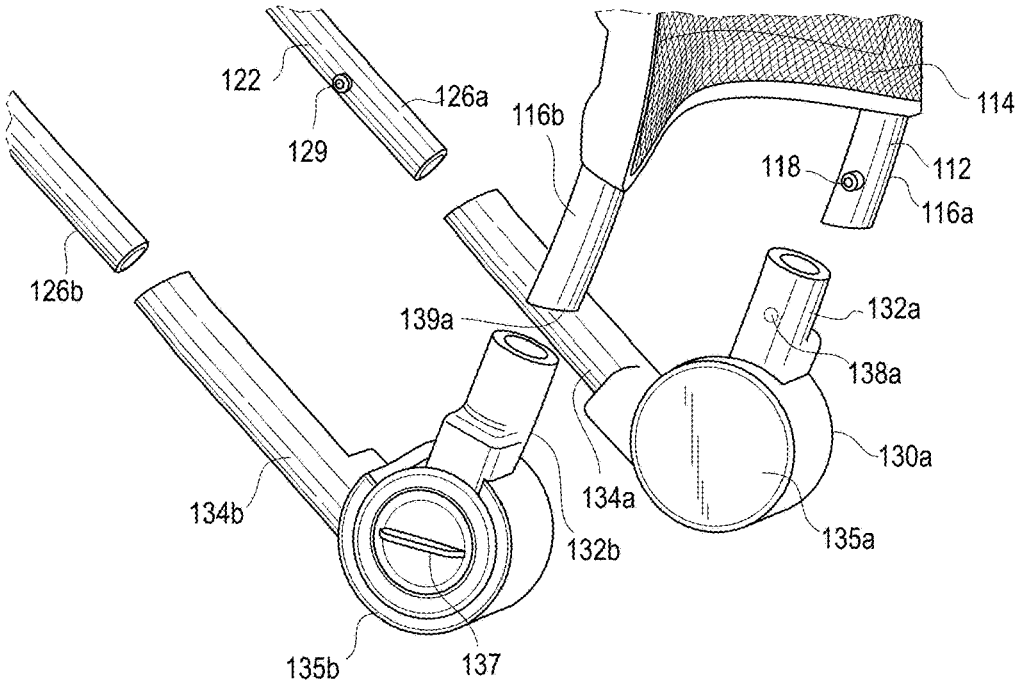
FIG. 3 is a partial, exploded view of the rebounding device of FIG. 1 in a disassembled configuration.

Referring to FIG. 3, a user is able to move the rebounding device 100 between a collapsed position for storage and/or travel, for example, as shown in FIG. 2 and an expanded position for rocking use as shown in FIG. 1. As discussed above, the rebounding device 100 has a front member 110 and a rear member 120 releasably connected to one another at first and second sides by junction members 130*a*, 130*b*. The frame 112 of the front member 110 includes two downwardly-extending members 116*a*, 116*b* intended for releasable connection to the junction members 130*a*, 130*b*, respectively. Each junction member 130*a*, 130*b* has a front tube, or sleeve, member 132*a*, 132*b* to receive the downwardly-extending members 116*a*, 116*b* of the front member 110 therein.

As shown positioned on the first downwardly-extending member 116*a* in FIG. 3, a resiliently-protruding locking member 118 extends therefrom to facilitate a locking engagement between the frame 112 of the front member 110 and the junction member 130*a*. The resiliently-protruding locking member 118 is configured to be closely received by an aperture 138*a* defined in the front tube member 132*a* of the junction member 130*a*. The aperture 138*a* is sized to receive the resiliently-protruding locking member 118 to minimize translation, rotation, and/or other movement of the frame 112 with respect to the junction member 130*a* in a locked configuration. The resiliently-protruding locking member 118 is configured to be depressed into a position where the resiliently-protruding locking member 118 is flush against the surface of the downwardly-extending member 116*a* in response to a force applied thereto. In such a depressed position, the downwardly-extending members 116*a*, 116*b* are easily slid into their respective front tube members 132*a*, 132*b*. Contact between the sidewalls of the front tube member 132*a* and the resiliently-protruding locking member 118 maintains the resiliently-protruding locking member 118 in its depressed position as a desired alignment is achieved. Upon substantially aligning with the aperture 138*a* defined in the front tube member 132*a*, the resiliently-protruding locking member 118 returns to its natural, fully-extended position. In such instances, the resiliently-protruding locking member 118 returns, or springs back, to its fully-extended position in the absence of an external force applied by a user and/or the sidewalls of the front tube member 132*a*. A user, or another suitable source, simply must apply a force to depress the locking member 118 to disassemble, or remove, the front panel 110 from the junction members 130*a*, 130*b*. While the described releasable locking mechanism is achieved using an aperture and a resiliently-protruding locking member, any suitable locking mechanism is envisioned for use that allows for selective locking engagement between the described components.

In various instances, only one of the downwardly-extending members 116*a*, 116*b* comprises the resiliently-protruding locking member 118. In other instances, a resiliently-protruding locking member 118 is present on both downwardly-extending members 116*a*, 116*b*. In various instances, the resiliently-protruding locking member 118 is present on one or both of the front tube members 132*a*, 132*b* and the aperture 138*a* is defined on one or both of the downwardly-extending members 116*a*, 116*b*; however, any suitable orientation is envisioned.

Similarly, the frame 122 of the rear member 120 includes two downwardly-extending members 126*a*, 126*b* intended for releasable connection to the junction members 130*a*, 130*b*, respectively. Each junction member 130*a*, 130*b* has a rear tube, or sleeve, member 134*a*, 134*b* to receive the downwardly-extending members 126*a*, 126*b* of the rear member 120 therein.

As shown positioned on the first downwardly-extending member 126*a*, a resiliently-protruding locking member 129 extends therefrom to facilitate a locking engagement between the frame 122 of the rear member 120 and the junction member 130*a*. The resiliently-protruding locking member 129 is configured to be closely received by an aperture 139*a* defined in the rear tube member 134*a* of the junction member 130*a*. The aperture 139*a* is sized to receive the resiliently-protruding locking member 129 to minimize translation, rotation, and/or other movement of the frame 122 with respect to the junction member 130*a* in a locked configuration. The resiliently-protruding locking member 129 is configured to be depressed into a position where the resiliently-protruding locking member 129 is flush against the surface of the downwardly-extending member 126*a* in response to a force applied thereto. In such a depressed position, the downwardly-extending members 126*a*, 126*b* are easily slid into their respective rear tube members 134*a*, 134*b*. Contact between the sidewalls of the rear tube member 134*a* and the resiliently-protruding locking member 129 maintains the locking member 119 in its depressed position as a desired alignment is achieved. Upon substantially aligning with the aperture 139*a* defined in the rear tube member 134*a*, the resiliently-protruding locking member 119 returns to its natural, fully-extended position. In such instances, the resiliently-protruding locking member 119 returns, or springs back, to its fully-extended position in the absence of an external force applied by a user and/or the sidewalls of the rear tube member 134*a*. A user, or another suitable source, simply must apply a force to depress the locking member 119 to disassemble, or remove, the rear panel 120 from the junction members 130*a*, 130*b*.

In various instances, only one of the downwardly-extending members 126*a,* 126*b* comprises the resiliently-protruding locking member 119. In other instances, a resiliently-protruding locking member 119 is present on both downwardly-extending members 126*a,* 126*b*. In various instances, the resiliently-protruding locking member 119 is present on one or both of the rear tube members 134*a,* 134*b* and the aperture 139*a* is defined on one or both of the downwardly-extending members 126*a,* 126*b;* however, any suitable orientation is envisioned.

Figure 4:
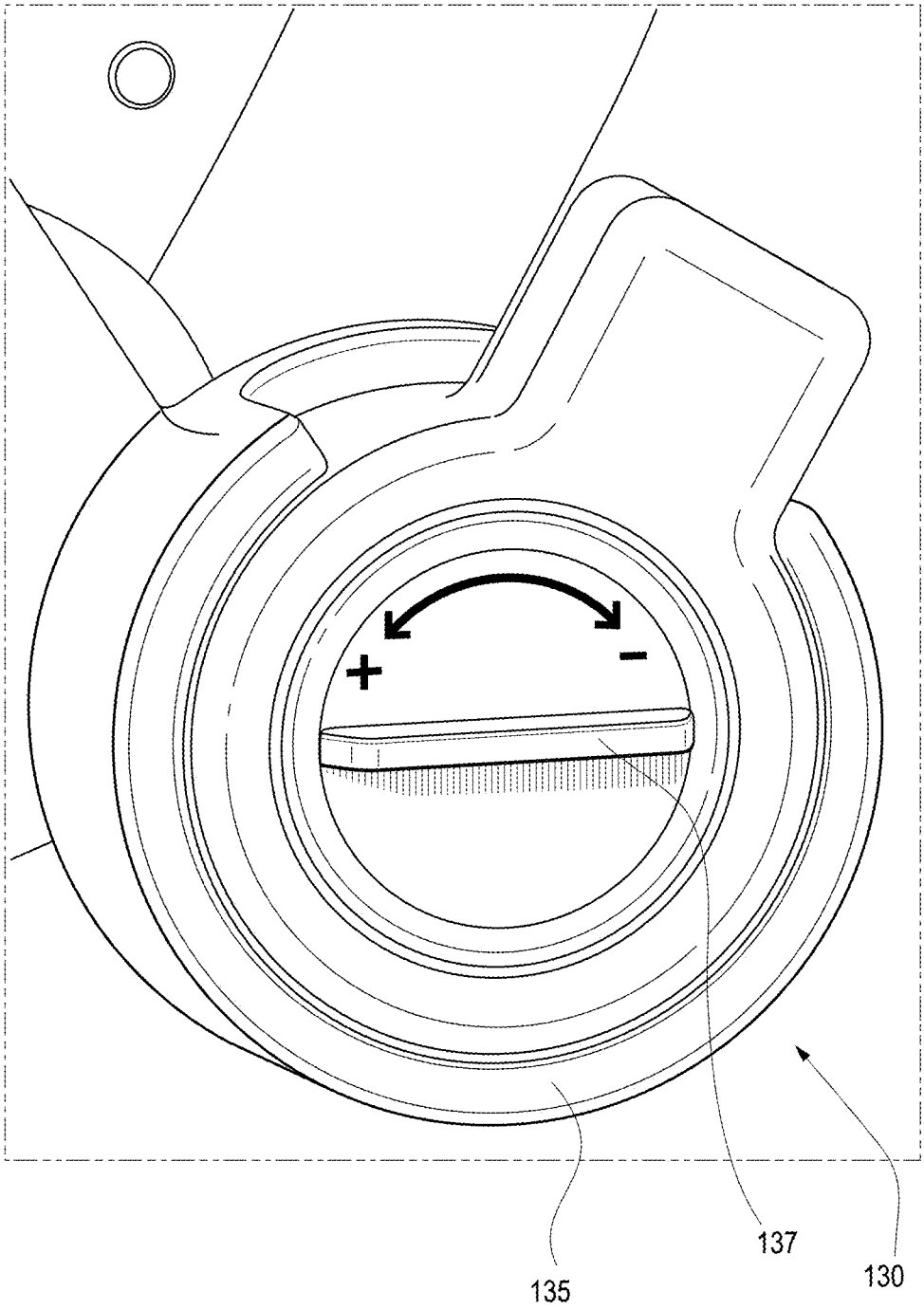
FIG. 4 is a partial, enlarged view of a junction member of the rebounding device of FIG. 1.
Figure 5:
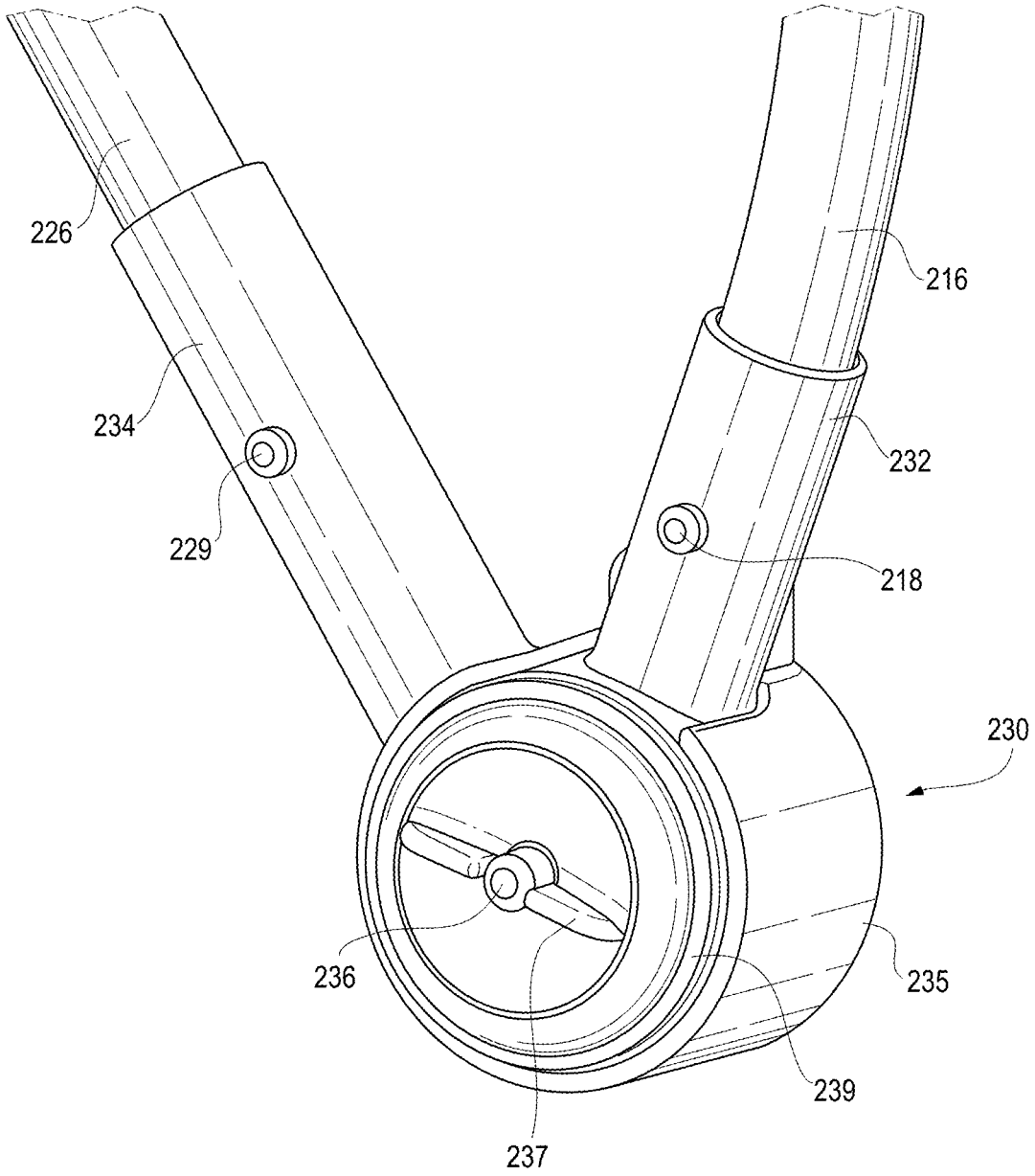
FIG. 5 is a partial, perspective view of a junction member of a rebounding device having an outer casing and a rotatable knob in accordance with at least one aspect of the present disclosure.
Figure 6:
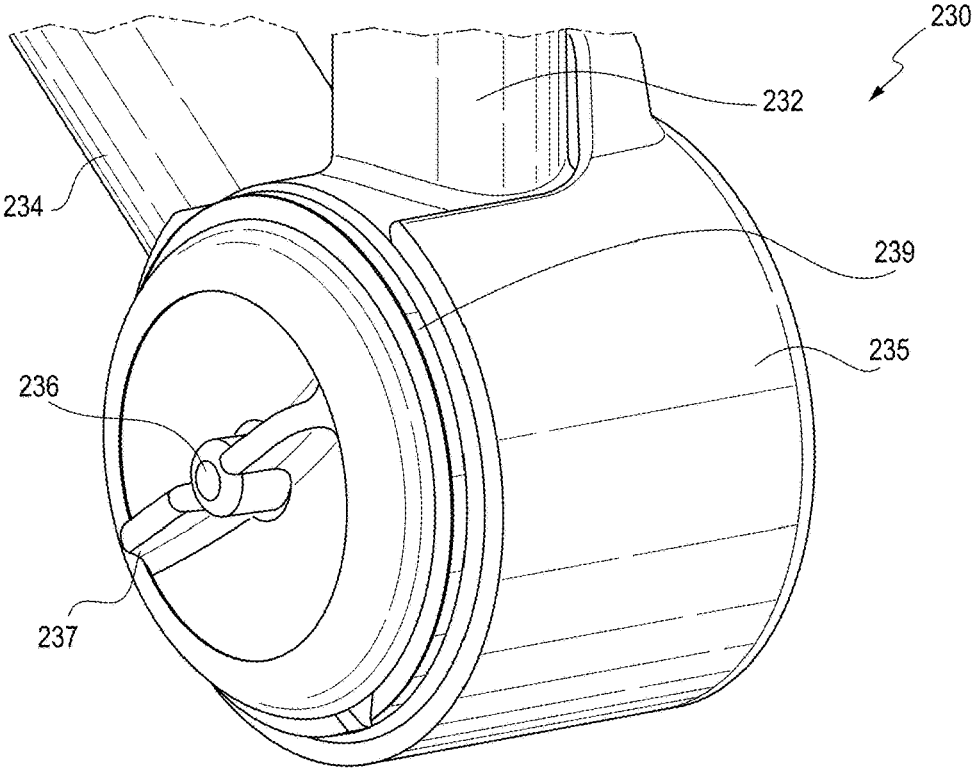
FIG. 6 is a partial, perspective view of the junction member of FIG. 5.
Figure 7:
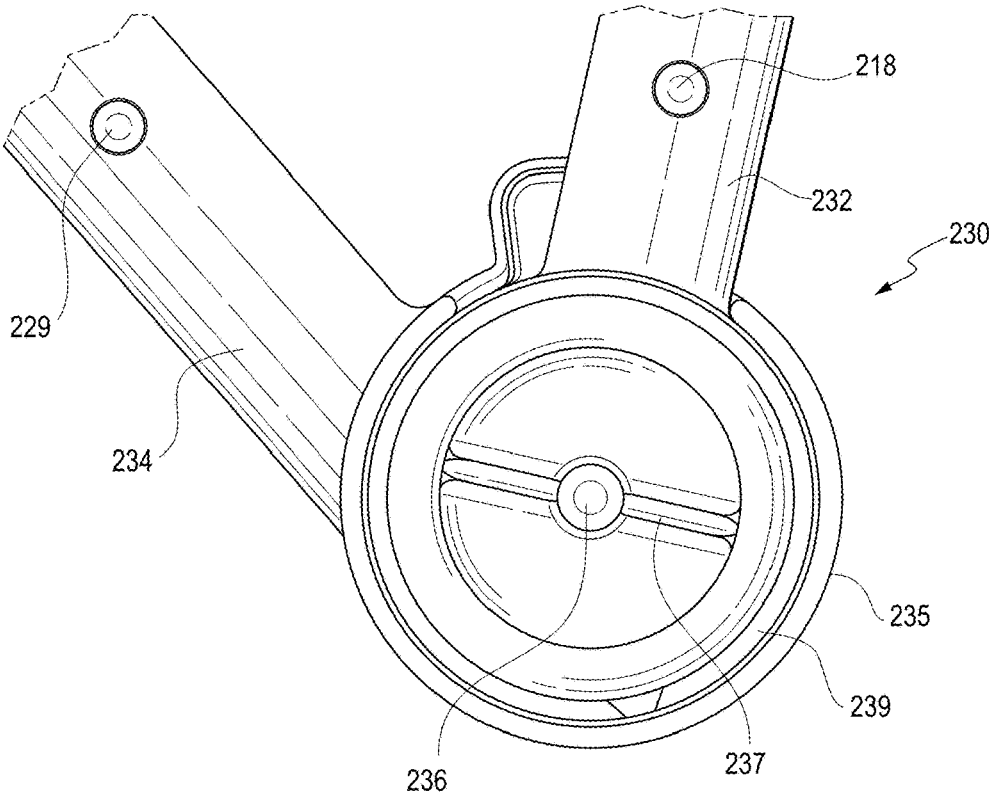
FIG. 7 is a partial, plan view of the junction member of FIG. 5.
Figure 8:
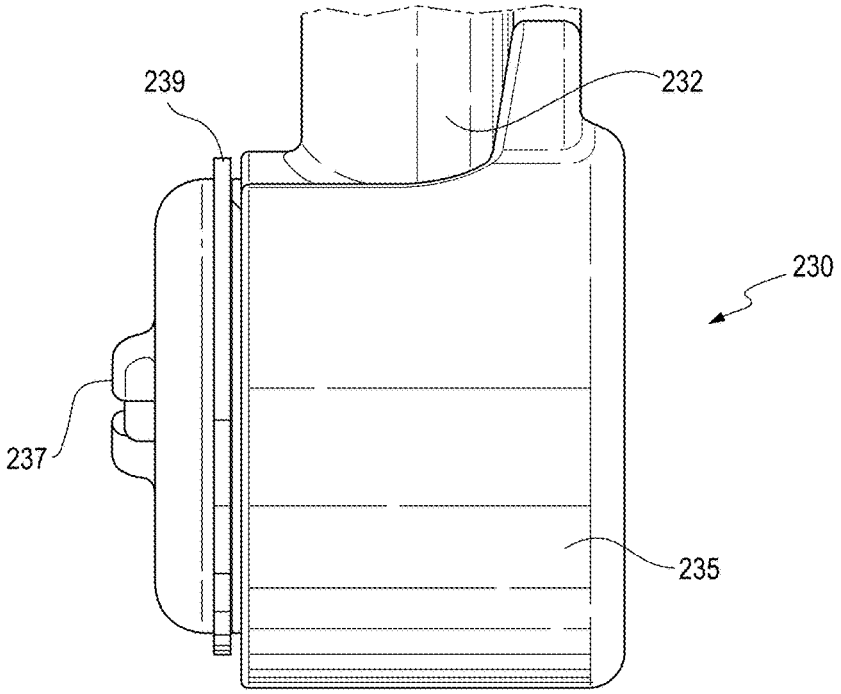
FIG. 8 is a partial, front view of the junction member of FIG. 5.

FIG. 4 depicts an enlarged view of one of the junction members 130*a,* 130*b*. Each junction member 130 has an outer casing 135 that comprises an arcuate geometry to facilitate a desired rocking motion of the rebounding device 100, as at least a portion of the outer casing 135 is configured to contact a ground, or horizontal, surface during use of the rebounding device 100. The junction member 130 includes a knob 137 rotatable in forward and reverse directions by a user relative to the outer casing 135 of the junction member 130 to adjust an amount of rebounding force provided by the rebounding device 100. In various instances, only one junction member 130*a* comprises a knob 137. In other instances, both junction members 130*a,* 130*b* comprise a knob 137. Internal components of the junction member 130 are discussed in greater detail herein.

Referring now to FIGS. 5-8, the external surfaces of a junction member 230 for use with a modular rebounding device, such as the device 100, are shown from various perspectives. Similar to the junction members 130*a,* 130*b* shown in FIGS. 1-4, the junction member 230 has a front tube, or sleeve, member 232 and a rear tube, or sleeve, member 234. The front tube member 232 is sized to slidably receive a downwardly-extending member 216 of a front member, such as front member 110, therein. As discussed in greater detail with respect to downwardly-extending member 112, the downwardly-extending member 216 of the front member has a resiliently-protruding member 218 extending therefrom. The front tube member 232 has an aperture defined therein to receive the resiliently-protruding member 218 when a desired and/or substantial alignment between the front member and the junction member 230 is achieved. The rear tube member 234 is sized to slidably receive a downwardly-extending member 226 of a rear member, such as rear member 120, therein. As discussed in greater detail with respect to downwardly-extending member 122, the downwardly-extending member 226 of the rear member has a resiliently-protruding member 229 extending therefrom. The rear tube member 234 has an aperture defined therein to receive the resiliently-protruding member 229 when a desired and/or substantial alignment between the rear member and the junction member 230 is achieved. Such resiliently-protruding members 218, 229 allow for easy assembly and disassembly of the modular rebounding device.

The junction member 230 further comprises an outer casing 235 rotatably supporting a knob 237 therein. The outer casing 235 is formed integrally with the rear tube member 234. The knob 237 is intended to be rotated by a user in forward and reverse directions relative to the outer casing 235 of the junction member 230 to adjust an amount of rebounding force provided by the rebounding device. A retaining ring 239 is positioned between the knob 237 and the outer casing 235 of the junction member 230 to facilitate such rotation. A depressible button 236 is positioned on the junction member 230 to allow for tension of the internal components to be released as will be discussed in greater detail herein.

Figure 9:
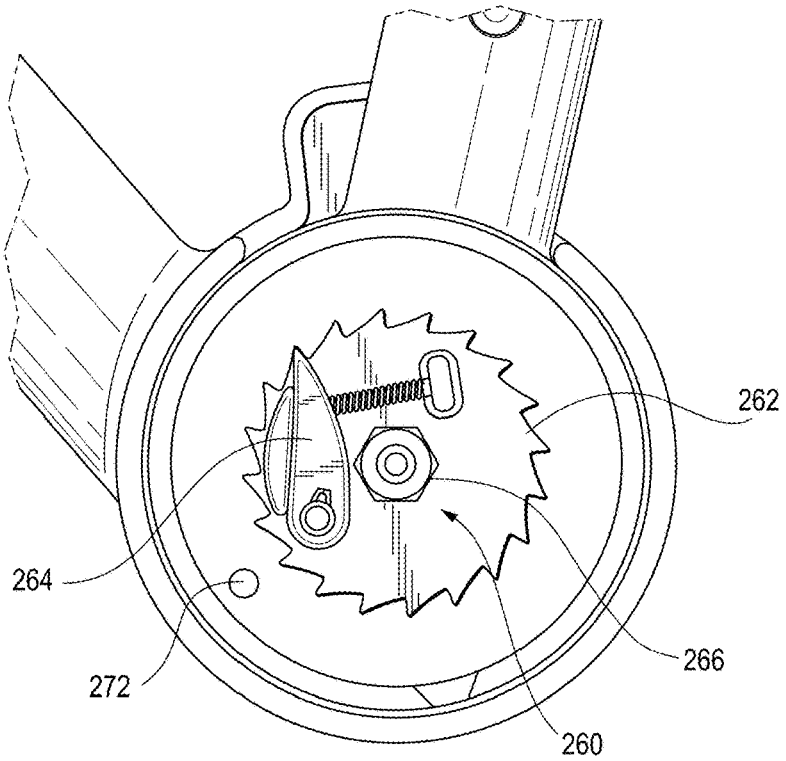
FIG. 9 is a partial, plan view of various internal components forming a force adjustment mechanism of the junction member of FIG. 5 with the rotatable knob removed for clarity.
Figure 10:
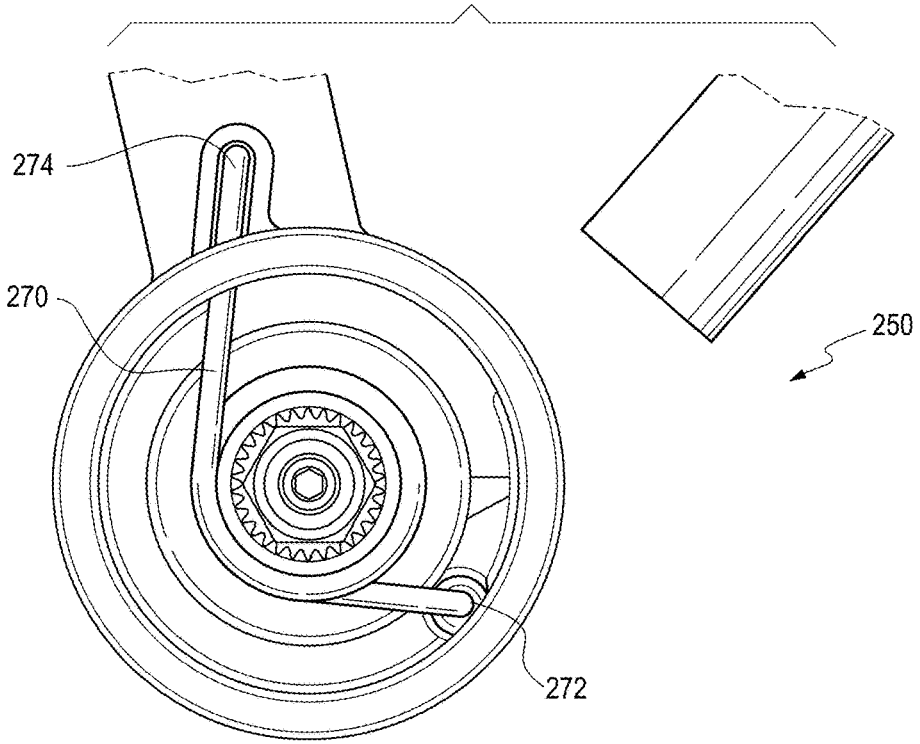
FIG. 10 is a partial, plan view of the force adjustment mechanism of FIG. 9 including a torsion spring.
Figure 11:
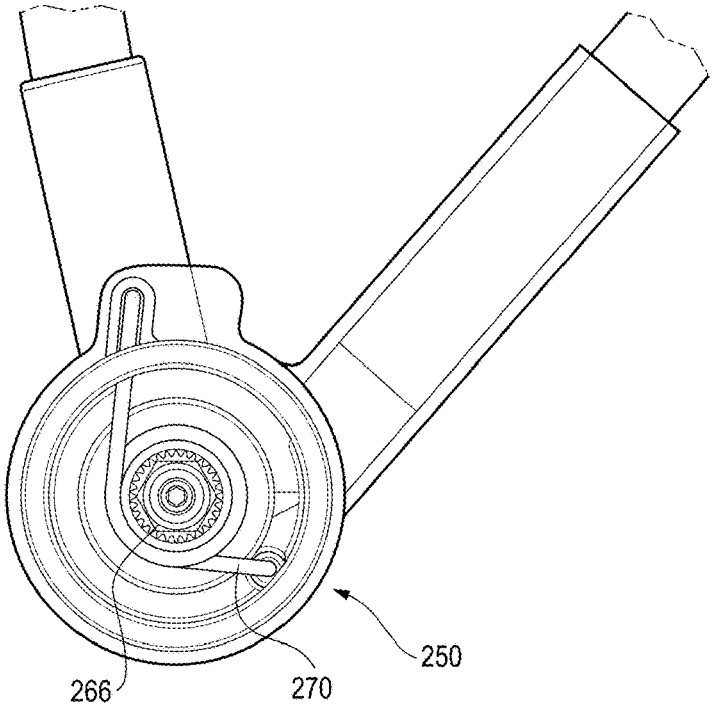
FIG. 11 is a partial, perspective view of the internal components of the force adjustment mechanism of FIG. 9.

Referring now to FIGS. 9-13, a force adjustment assembly 250 positioned within the junction member 230 is shown. The force adjustment assembly 250 includes a ratchet/pawl system 251 that is keyed into the outer casing 235, which is stationary relative to the rear member 120, and a torsion spring 270 (FIG. 10) that allows the front member 110 to move toward and away from the rear member 120. The torsion spring 270 is secured to the ratchet/pawl system 251. The torsion spring 270 is connected to the rear member 120 at a first connection point 272 (FIG. 9) and to the front member 110 at a second connection point 274 (FIGS. 10 and 1). Using the knob 237, the user can release the ratchet/pawl system 251 from the outer casing 235, thereby allowing the front and rear members 110, 120 to move together into the collapsed position, or adjust the biasing strength of the torsion spring 272 while the ratchet/pawl system 251 is engaged with the outer case 235 while in the expanded position.

The ratchet/pawl system 251 comprises a spring-loaded, or locking, pawl 264 that is a movable, spring-loaded lever configured to engage a ratchet gear 262 to prevent movement of the ratchet gear 262 in a particular direction and/or restrain the gear 262 from moving altogether. As depicted in FIG. 9, the pawl 264 is tapered, being wider at its pivot point and narrow at its tip, where the pawl 164 engages the ratchet gear 262. A spring 263 is positioned between a mount on the ratchet gear 262 and the tip of the pawl 264 to urge the pawl 264 into the teeth 262*a* of the gear 262.

The torsion spring 270 (FIG. 10) includes a first torsion spring connection end 272 located in the junction member 230 and a second torsion spring connection end 274 located on a downwardly-extending member 226 of the rear member, such as rear member 120.

Figure 12A:
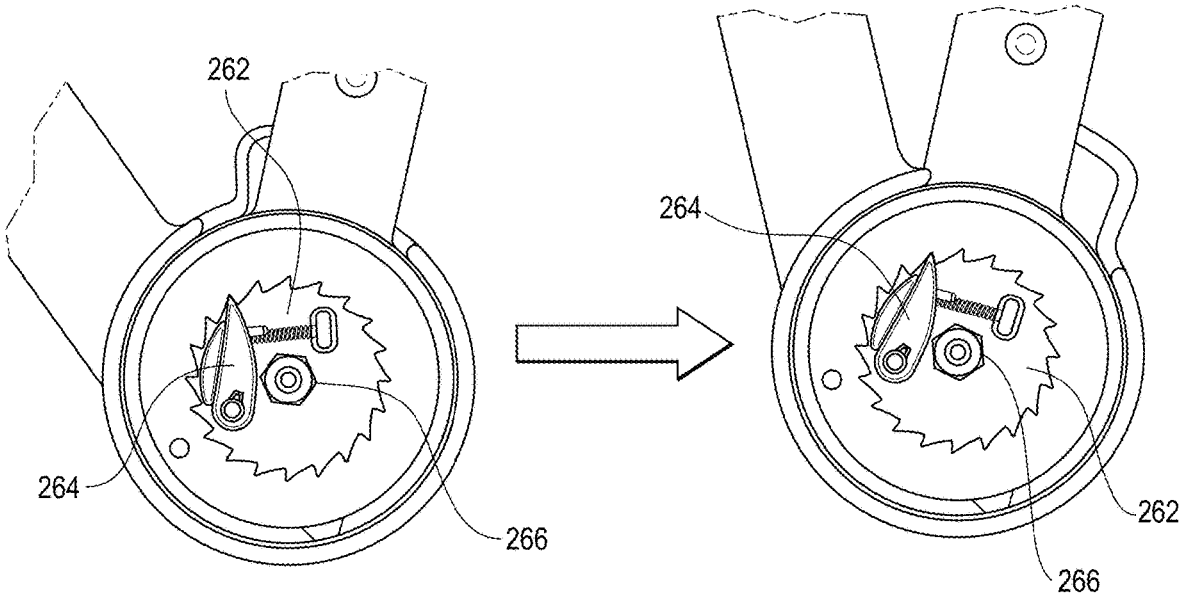
FIG. 12A is a partial, perspective view of the internal components of the force adjustment mechanism of FIG. 9 as the rebounding device is motivated from an uncompressed, open state to a compressed state during a backward rocking motion.
Figure 12B:
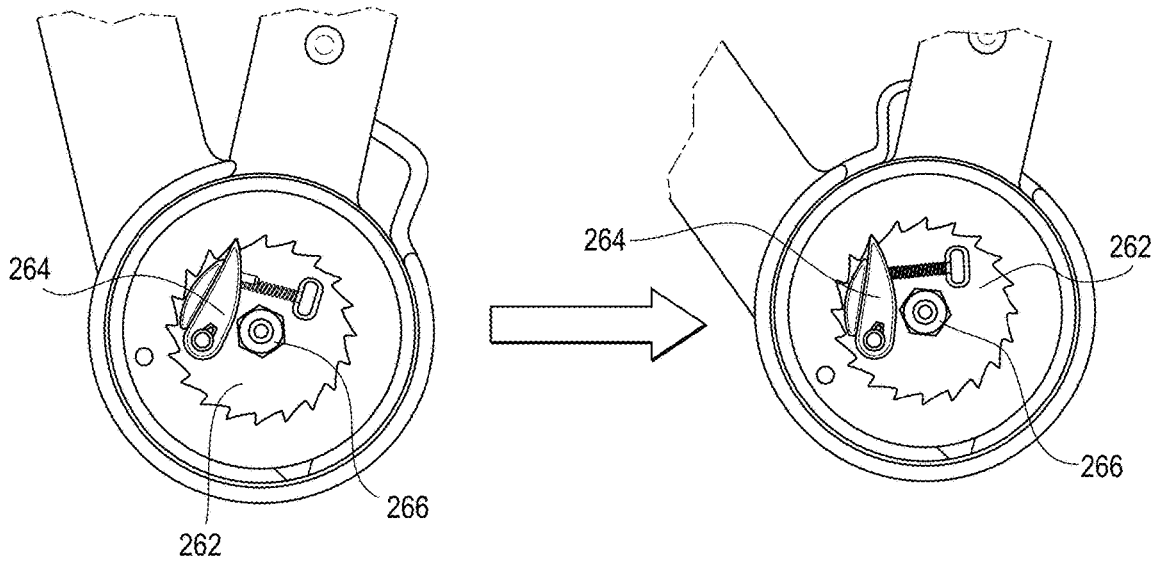
FIG. 12B is a partial, perspective view of the internal components of the force adjustment mechanism of FIG. 12A as the rebounding device is motivated from the compressed state to the uncompressed state during a forward rocking motion.

FIGS. 12A and 12B demonstrate the movement of the force adjustment assembly 250 during use. As discussed herein, the user positions the rear surface 104 of the device 100 against a stationary object such as a chair, wall, tree, etc., for example. The user rests his back against the front member, such as front member 110, and applies pressure to generate a gentle rocking motion to move the rebounding device through a range of positions between a least compressed position and a most compressed position.

Shown in FIG. 12A, as a user begins to rock backward and apply pressure on the rebounding device 100, the ratchet gear 262 begins to rotate against the locking pawl 264. Resistance of such rotation from the locking pawl 264 results in the rotation of a bolt 266. Such rotation of the bolt 266 loads the torsion spring 270. In the most compressed position, the front member 110 is closest to the rear member 120. Components of the junction member 130, 230 then exert a biasing force when compressed that propels the user's upper body forward while maintaining a seated position. Shown in FIG. 12B, as a user rocks forward, or releases pressure on the rebounding device, the torsion spring 270 unloads and returns the rocker to an open, or uncompressed position. In the least compressed, or open, position, the front member 110 is farthest from the rear member 120. The rebounding device may be in a partially compressed position, with the front member 110 located at a mid-way position to the rear member 120 and/or at a plurality of positions between the least and most compressed positions.

The user can adjust the biasing force by rotating the knob 237 of the force adjustment assembly 250 as desired. More specifically, as the knob 237 is rotated in a first direction, the spring-loaded pawl 264 resists rotation of the ratchet gear 262, thereby loading the torsion spring 270 and increasing the tension therein. As the knob 237 is rotated in a second, opposite direction, the tension in the torsion spring 270 is released.

Figure 13:
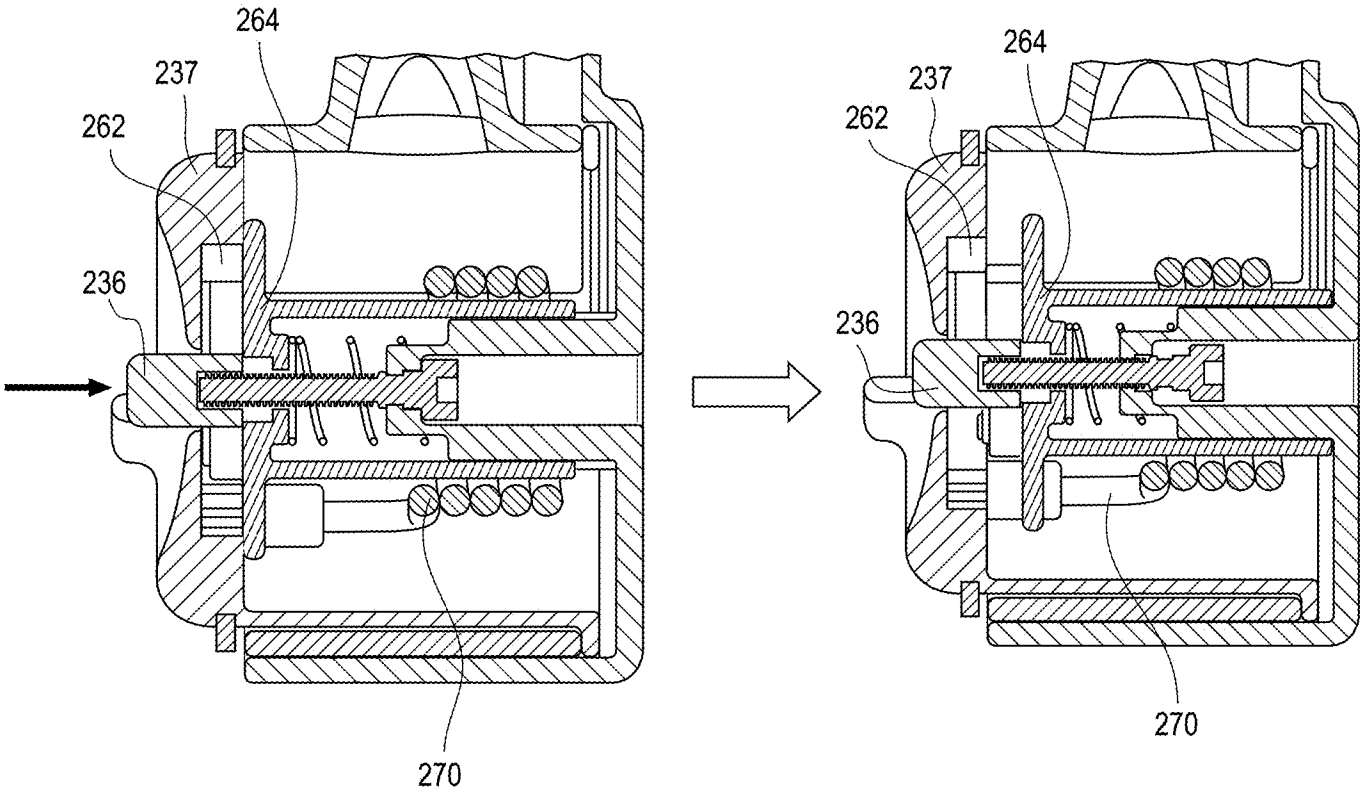
FIG. 13 is a partial, cross-sectional view of the junction member of FIG. 5 as a torsion spring is unloaded.

Referring to FIG. 13, the user can also release the biasing force altogether by pressing a button within the knob 237. The force adjustment assembly 250 comprises a depressible button 236 positioned along the knob 237 an exterior surface of the junction member 230 to allow for tension of the torsion spring 270 to be released. A back surface 230*a* of the junction member 230 includes a column 230*b* having a ledge on which a spring 238 is positioned. The spring 238 biases the ratchet gear 262 away from the back surface 230*a* of the junction member 230, and application of a force to the depressible button 236 pushes the ratchet gear 262 toward the back surface 230*a* of the junction member 230 and away from the spring-loaded pawl 264, thereby allowing the torsion spring 270 to unwind to a minimum force position.

The torsion spring 270 may be comprised of any material that provides sufficient elasticity to enable repeated rebounding motions while being sufficiently strong to structurally support a person's weight. Example metallic materials include aluminum, an aluminum alloy preferably but not necessarily having a T6 temper, such as 6061T6, steel, and a steel alloy such as AISI 5160. The device may also be made of plastic such as polyvinyl chloride, a carbon fiber composite material, or a wood material.

The user can adjust the biasing force using small incremental changes to increase or decrease the pounds of biasing force provided by the force adjustment assembly 250 by rotating the knob 237 with respect to the outer casing 235. The force adjustment assembly 250 enables the user to select the precise force appropriate for the specific size, shape, and condition of the body using the device. Rotation of the knob 237 in a first direction may correspond to a preloaded setting that is greater than a current setting while rotation of the knob 237 in a second, opposite direction may correspond to a preloaded setting that is less than the current setting.

While the rebounding device(s) disclosed herein are described as being modular and/or easily disassembled, one or more components of the rebounding device(s) may be formed integrally. For example, the front member 110, the rear member 120, and/or the junction members 130*a*, 130*b* may be formed integrally. In various instances, the disclosed rebounding device(s) may be comprised of a metal such as an aluminum alloy, that is stamped, laser cut, water-jetted, or otherwise cut from a sheet of the material and pressed into formation. In other instances, the rebounding device(s) may comprise a wooden material shaped into formation. In still further instances, the rebounding device(s) may be a polyvinyl chloride material that is that is molded, such as injection molded, into formation. The material(s) and method(s) of manufacture may vary based on the manufacturing process or as desired.

In various instances, the force adjustment assembly 250 may be modified to include one or more reinforcing spring elements that provide additional elasticity and/or strength to account for heavier users. The number, position, and location of reinforcing elements may vary as desired or, in some embodiments, based on the user's preference. In some embodiments, the reinforcing spring elements added to any part of the force adjustment assembly 250 may be adjustable.

The force adjustment assembly 250 described herein is one example assembly with components that interact to provide an adjustable biasing force as well as an option to collapse the rocking device into a transportable position. Other components may be used in lieu of the ratchet/pawl system, the torsion spring, or any other element as desired or needed.

In various instances, the rebounding devices disclosed herein may include first and second rubber guards that extend along a bottom surface of the junction members 130*a*, 130*b*, 230. The rubber guards may include treaded portions that prevent the rebounding device from slipping on the floor, the seat of a chair, or other surface during use.

The rebounding device 100 may also include accessories such as arm rests, pockets, straps for attaching pillows or other cushions, straps for holding the front and rear members in the collapsed position, and hooks for hooking the device onto a chair or other structure may be included as well.

The dimensions of the rebounding device(s) disclosed herein may be modified in order to tailor the device to a specific use and/or for an individual user. For example, the width of the rebounding device and/or size of the junction members may be larger than illustrated herein in order to accommodate for usage with a wheelchair or a hospital bed.

As described above, the rebounding device can be used in a variety of applications, from comfortable seating for gamers, to rocking an infant to sleep, to the comfort and benefit for those with conditions such as dementia, anxiety, and autism. It should be noted that various changes and modifications to the presently preferred embodiments described herein will be apparent to those skilled in the art. Such changes and modifications may be made without departing from the spirit and scope of the present invention and without diminishing its attendant advantages.

What is claimed is:

1. A rebounding device comprising:

a front member;

a rear member; and a junction member releasably coupling the front member and the rear member so that the front member and the rear member move between a collapsed position and an expanded position, wherein the front member is movable relative to the rear member during a rocking motion when the junction member is in the operable position, wherein the junction member comprises:

an outer casing that connects to the rear member;

a ratchet gear releasably connected to the outer casing;

a spring-loaded pawl configured to engage the ratchet gear and prevent rotation thereof;

a torsion spring including a first connection end and a second connection end, wherein the first connection end is secured to the ratchet gear and the second connection end is secured to the front member; and a release button to release tension in the torsion spring, wherein application of pressure by a user against the front member causes the front member to move toward the rear member thereby loading the torsion spring, and wherein removal of the pressure against the front member causes the torsion spring to unload thereby biasing the front member away from the rear member.

2. The rebounding device of claim 1, wherein the front member comprises a first downwardly-extending member, wherein the junction member comprises a front tube configured to releasably receive the first downwardly-extending member therein.

3. The rebounding device of claim 2, wherein the first downwardly-extending member comprises a resiliently-protruding locking member, wherein the front tube of the junction member comprises an aperture defined therein, and wherein the aperture is sized to receive the resiliently-protruding locking member therein.

4. The rebounding device of claim 2, wherein the rear member comprises a second downwardly-extending member, wherein the junction member comprises a rear tube configured to releasably receive the second downwardly-extending member therein.

5. The rebounding device of claim 1, wherein the front member and the second member are selectively lockable to the junction member.

6. The rebounding device of claim 1, wherein the junction member comprises a bottom surface comprising an arcuate geometry, wherein at least a portion of the bottom surface is configured to contact a ground surface during use of the rebounding device.

7. The rebounding device of claim 1, wherein the junction member further comprises a knob rotatably positioned thereon, wherein rotation of the knob in a first direction increases preloaded tension in the torsion spring, and wherein rotation of the knob in a second direction decreases preloaded tension in the torsion spring.

8. The rebounding device of claim 1, wherein the junction member further comprises a knob rotatably positioned thereon to adjust a preloaded tension in the torsion spring.

9. The rebounding device of claim 1, further comprising a head rest panel resiliently extending above the front member.

10. A rebounding device comprising:

a front member;

a rear member; and a junction member releasably coupling the front member and the rear member so that the front member and the rear member move between a collapsed position and an expanded position, wherein the front member is movable relative to the rear member during a rocking motion when the junction member is in the operable position, wherein the junction member comprises:

an outer casing that connects to the rear member;

a ratchet gear releasably connected to the outer casing;

a spring-loaded pawl configured to engage the ratchet gear and prevent rotation thereof;

a torsion spring including a first connection end and a second connection end, wherein the first connection end is secured to the ratchet gear and the second connection end is secured to the front member; and a release button to release tension in the torsion spring.

* * * * *